US008127520B2

(12) United States Patent
Giro Amigo

(10) Patent No.: US 8,127,520 B2
(45) Date of Patent: Mar. 6, 2012

(54) DEVICE FOR THE FILLING OF BAGS

(75) Inventor: Ezequiel Giro Amigo, Badalona (ES)

(73) Assignee: Girnet Internacional, S.L., Badalona (ES)

( * ) Notice: Subject to any disclaimer, the term of this patent is extended or adjusted under 35 U.S.C. 154(b) by 258 days.

(21) Appl. No.: 12/541,695

(22) Filed: Aug. 14, 2009

(65) Prior Publication Data

US 2010/0058713 A1 Mar. 11, 2010

(30) Foreign Application Priority Data

Sep. 5, 2008 (ES) ..... 200801821 U

(51) Int. Cl.
*B65B 9/06* (2006.01)

(52) U.S. Cl. ..... 53/551; 53/545

(58) Field of Classification Search ..... 53/545, 53/548, 550, 551, 552, 450, 451, 251, 252
See application file for complete search history.

(56) References Cited

U.S. PATENT DOCUMENTS 3,389,533 A * 6/1968 Tipper et al. ..... 53/134.1
4,277,932 A * 7/1981 Campbell ..... 53/497
4,370,844 A * 2/1983 Degn et al. ..... 53/546
5,611,193 A * 3/1997 Farrelly ..... 53/475
6,209,293 B1 * 4/2001 Powers ..... 53/475
7,107,742 B2 * 9/2006 Blanc ..... 53/537
7,704,129 B2 * 4/2010 May et al. ..... 452/32
7,955,165 B2 * 6/2011 May et al. ..... 452/30

* cited by examiner

*Primary Examiner* — Paul Durand
(74) *Attorney, Agent, or Firm* — Sughrue Mion, PLLC

(57) ABSTRACT

The invention relates to a device for the filling of bags in automatic machines for the formation, filling and closing in a continuous process of bags from a tubular mesh, of those comprising a tubular body outside which the storage of tubular mesh is assembled, the device comprising means for the conveyance of individual pieces of large fruit and vegetable products, such as melons, watermelons or the like, from a loading position to a delivery position, and means for the holding and transfer, one by one, of the individual pieces conveyed to the delivery position, which comprise a head for the holding and subsequent release of the pieces and a mechanism for transmitting to the head a movement the path of which comprises a vertical downward section, of a sufficient length to convey the held piece through the inside of the tubular body of the machine towards the mouth of a bag open at the upper part, and such that the piece is accompanied in its entire downward path.

12 Claims, 3 Drawing Sheets

DEVICE FOR THE FILLING OF BAGS

TECHNICAL FIELD OF THE INVENTION

The invention relates to a device for the filling of bags, applicable to automatic machines for the formation, filling and closing in a continuous process of bags from a tubular mesh. The device is particularly suitable for filling bags with large fruit and vegetable products, such as melons and watermelons, which must be handled preventing falls or blows due to their fragility.

BACKGROUND OF THE INVENTION

In automatic machines for the formation, filling and closing of bags obtained from a continuous tubular mesh it is usual to obtain, as an intermediate product, tubular mesh portions closed at their bottom and open at the upper part which, in a work station of the machine, are filled with the products that the bags are to contain once finished. While in some machines the mesh portions are separated from the continuous tubular mesh and are held by the edges of their mouth, keeping them open, in other machines the mesh portions are not separated from the rest of the tubular mesh until the products are introduced therein. In any case, the products are usually dropped from a certain height such that, by the effect of gravity, they are introduced in the mesh portions through their mouth.

Thus, for example, a type of known machine is that comprising a tubular body on which a storage of continuous tubular mesh is externally assembled and through which a predetermined number of pieces of the product is dropped from an upper hopper, which is deposited at the closed end of a mesh portion which is extended below the level of the mouth of the mentioned tubular body and which determines the bottom of a bag being formed. At the lower end of the tubular body there are provided means to prevent the unwanted dragging of a length of mesh exceeding the length of the bag being formed, when the pieces of the product suddenly impinge on the bottom of the bag being formed. Once the pieces have been introduced in the tubular mesh portion, the latter is closed at the upper part and is separated from the rest of the tubular mesh, a bag full of product thus being obtained.

This way of filling the bags being formed is not applicable for certain large or heavy products such as melons or watermelons, due to the fact, among other reasons, that they are excessively fragile and therefore are easily spoilt or damaged when they are dropped from a certain height, and that they exert an excessive force on the tubular mesh when they impinge on the bottom thereof, being able to break it. For these reasons, known machines have not been used to date for packaging products other than citrus fruits, tubers or products with similar characteristics, which can be accumulated in hoppers and subsequently dropped to fill the bags, without being damaged.

DISCLOSURE OF THE INVENTION

The device according to the invention solves the aforementioned drawbacks and is furthermore applicable to already known automatic machines for the formation, filling and closing in a continuous process of bags from a tubular mesh, of those comprising a tubular body outside which the storage of tubular mesh is assembled.

The device is essentially characterized in that it comprises means for the conveyance of individual pieces of large fruit and vegetable products, such as melons, watermelons or the like, from a loading position to a delivery position; and means for the holding and transfer, one by one, of the individual pieces conveyed to the delivery position, which comprise a head for the holding and subsequent release of the pieces and a mechanism for transmitting to the head a movement the path of which comprises a vertical downward section, of a sufficient length to convey the held piece through the inside of the tubular body of the machine towards the mouth of a bag open at the upper part, and such that the piece is accompanied in its entire downward path.

According to a variant of the invention, for the purpose of preventing the accidental release of the pieces the means for the conveyance of the pieces comprise a carriage assembled movably in a fixed structure and according to an alternating back and forth essentially horizontal linear movement between the end loading and delivery positions, and vice versa, and the mechanism of the means for the holding and transfer of the pieces imparts to the head a path formed only by vertical upward and downward sections, aligned with the position occupied by the piece when the carriage reaches the delivery position.

According to another variant of interest, the means for the conveyance of the pieces comprise a carriage assembled rotatingly in a fixed structure about a vertical axis, describing an alternating and essentially horizontal circumferential arc movement between the loading and delivery positions, and vice versa.

According to another feature of the invention, the mechanism of the means for the holding and transfer of the pieces is suitable for leading the head while the latter holds a piece until a level below the level of the carriage and in a manner synchronized with the movement thereof, such that at least while the pieces are conveyed along the vertical downward section towards the bag and during the consecutive vertical upward section of the head, the carriage adopts the end loading position, moved outside the path of the head.

The carriage preferably comprises a concavity optionally open at its bottom intended to partially house the piece to be conveyed.

The carriage furthermore comprises stop means to prevent, by the effect of inertia, the piece from coming out of the concavity in which it is housed when the carriage speeds up or slows down in its back and forth movement.

According to a variant of particular interest, the mechanism comprises a hydraulic, pneumatic or electric cylinder the plunger of which drives a rod with longitudinal movement, dragging the head in its movement.

According to another feature of the invention, the head comprises a suction cup suitable for grasping the piece by means of vacuum when it is pressed against the smooth surface of said piece.

Another aspect of the invention is an automatic machine for the formation, filing and closing in a continuous process of bags, said machine comprising a tubular body and being provided with a device according to anyone of the claims 1 to 9, in which the mechanism for transmitting to the head a vertical movement is adapted to introduce the held piece into the tubular body through its upper open mouth and to convey the held piece through the inside of said tubular body, along a downward section, to deliver the held piece though its lower opens mouth.

BRIEF DESCRIPTION OF THE DRAWINGS

The attached drawings illustrate, by way of a non-limiting example, an embodiment of the device according to the invention. In said drawings.

DETAILED DESCRIPTION OF THE DRAWINGS

Figure 1:
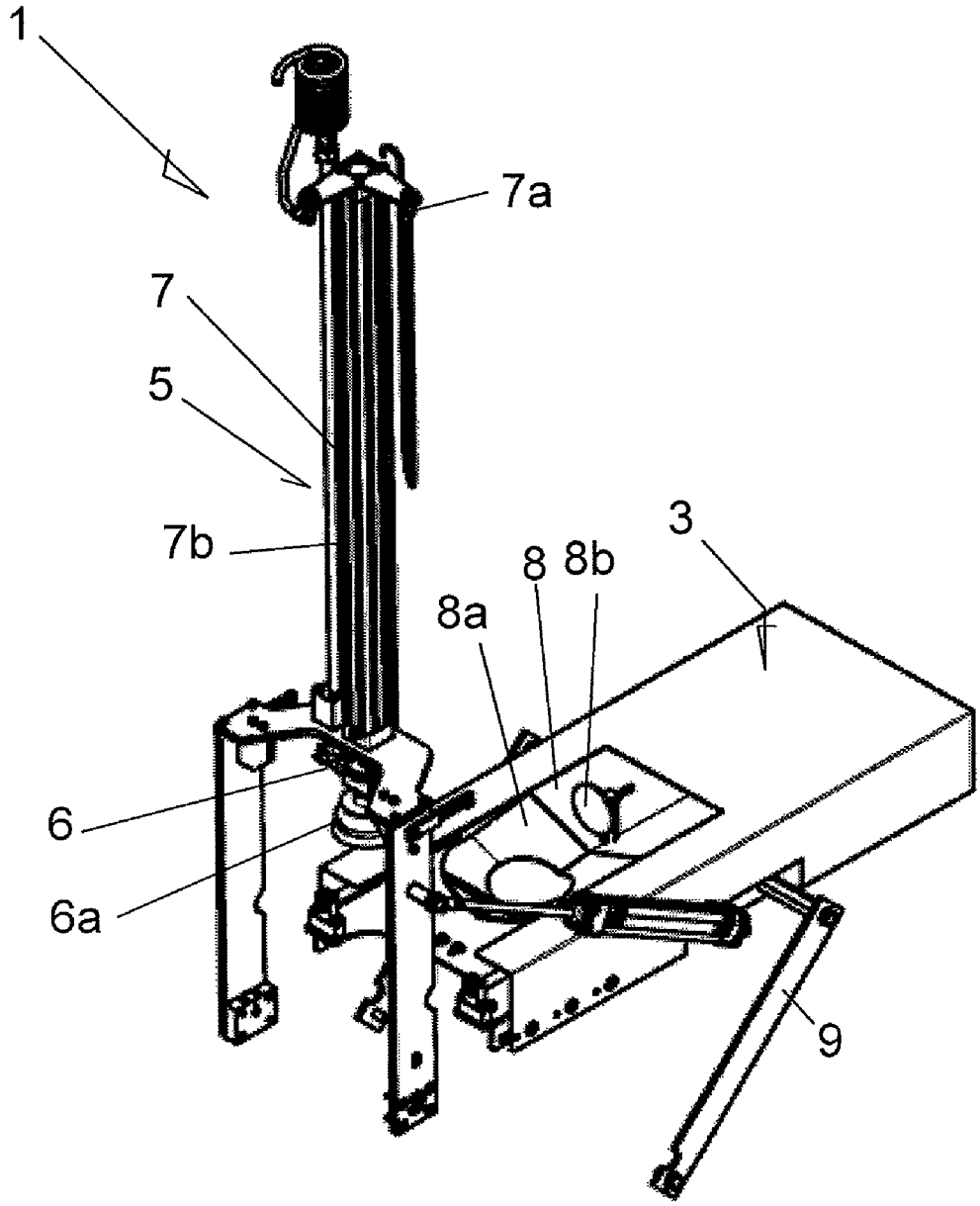
FIG. 1 is a perspective view of a device according to the invention.
Figure 2:
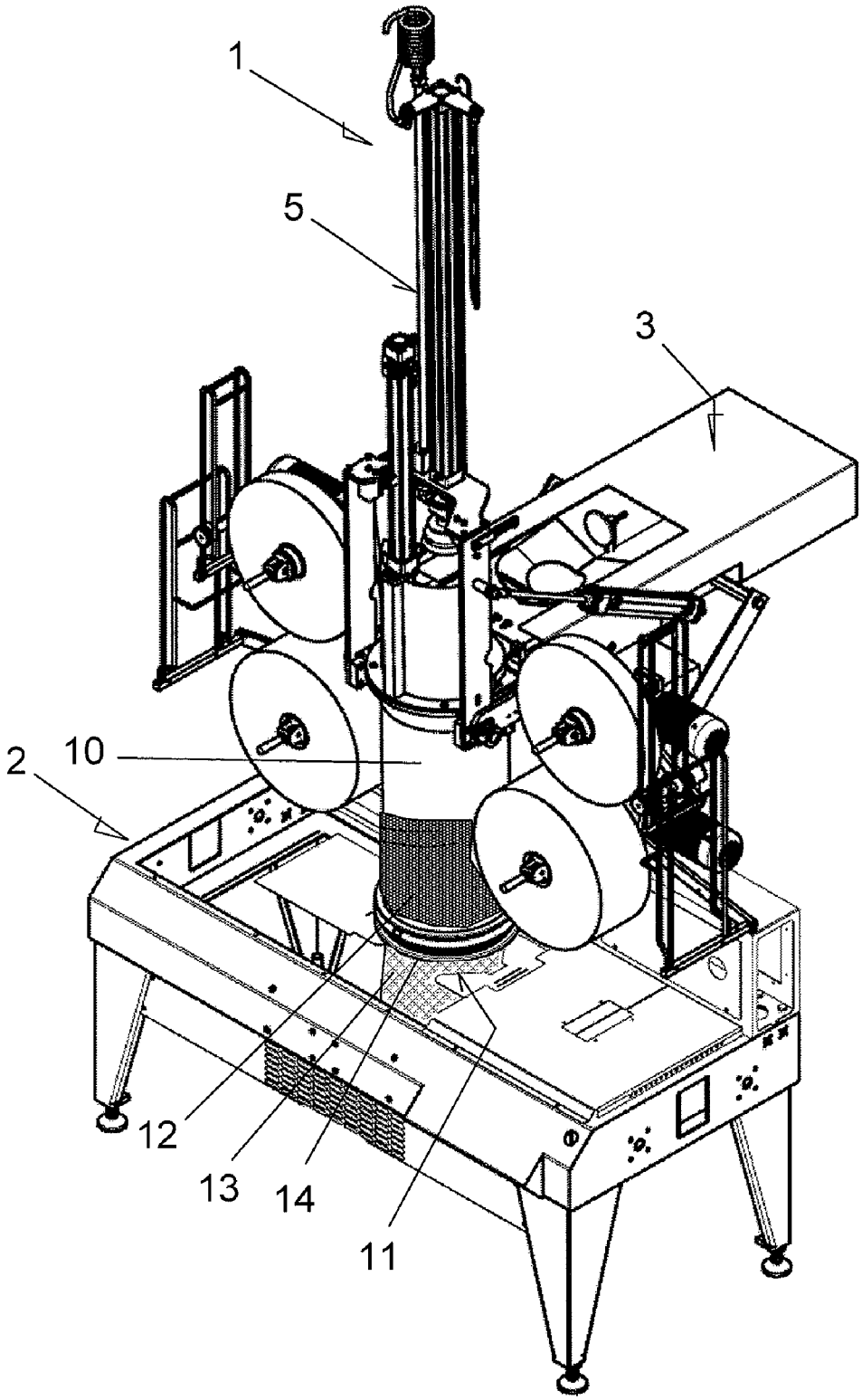
FIG. 2 is a perspective view of an automatic machine for the manufacture, filling and subsequent closure of bags obtained from a tubular mesh, provided with a device for the filling of bags being formed according to the invention.

The device 1 depicted in FIG. 1 is especially suitable for its intervention in the manufacturing process followed by an automatic machine for the manufacture, filling and subsequent closure of bags from a storage of tubular mesh 12 depicted in FIG. 2. The automatic machine 2 is of the type of those in which the tubular mesh 12 is stored outside the vertical tubular body 10 keeping the tubular mesh 12 expanded. Below the mouth of said tubular body 10 there are arranged respective closing and cutting mechanisms 11 for closing and cutting the tubular mesh 12, which close the end of the mesh portion 13 extended below the tubular body 10 to close the finished bag and to form the bottom of the bag being formed. It is observed in FIG. 2 that the device 1 is located at the upper part of the machine 2, above the tubular body 10, such that the pieces of product which are to be introduced in the bags are introduced through the upper mouth of the tubular body 10 and are taken through its inside until reaching the level of the lower mouth 14 of the tubular body 10, close to the bottom of the bag being formed. In short, the device 1 according to the invention is suitable for existing machines replacing the unloading hopper which is conventionally located above the tubular body 10. It is therefore not necessary to modify important parts of the machine for the latter to work with the device 1 according to the invention, the bags being able to be filled with melons, watermelons or the like using known machines, which is of especial interest.

The device 1, depicted isolated in FIG. 1, comprises means for the conveyance 3 in a stable manner of individual pieces 4 (see FIGS. 3 to 9) of large fruit and vegetable products, such as melons, watermelons or the like, from a loading position to a delivery position superimposed on the upper mouth of the tubular body. The device further comprises means for the holding and transfer 5, one by one, of the individual pieces conveyed to the delivery position, which comprise a head 6 for the holding and subsequent release of the pieces and a mechanism 7 for transmitting to the head a movement the path of which coincides with the axis of the tubular body to deposit the piece in a bag being formed, open at the upper part, such that the piece is accompanied in its entire downward path until it is deposited in the bottom of the bag.

The means for the conveyance 3 of the pieces comprise a carriage 8 assembled movably in a fixed structure 9 and according to an alternating back and forth essentially horizontal movement between the end loading and delivery positions, the latter also coinciding with the axis of the tubular body, and vice versa. In relation to the mechanism 7 of the means for the holding and transfer 5 of the pieces, it imparts to the head 6 a path formed only by vertical upward and downward sections, aligned with the position occupied by the piece when the carriage reaches the delivery position, and in other words, aligned with the axis of the tubular body.

For the purpose of conveying the pieces, which can have a cylindrical or oval contour, in a stable manner, the carriage 8 comprises a concavity 8*a* open at its bottom which houses the piece to be conveyed, the carriage further being provided with stop means 8*b* to prevent, by the effect of inertia, the piece from coming out of said concavity 8*a* when the carriage 8 speeds up or slows down in its back and forth movement.

The mechanism 7 depicted in the example of FIGS. 1 and 2 comprises a hydraulic cylinder 7*a* the plunger of which drives a rod 7*b*, with longitudinal movement, dragging the head 6 in its movement, which head 6 comprises a suction cup 6*a* suitable for grasping the piece by means of vacuum when it is pressed against the smooth surface of said piece.

Figure 3:
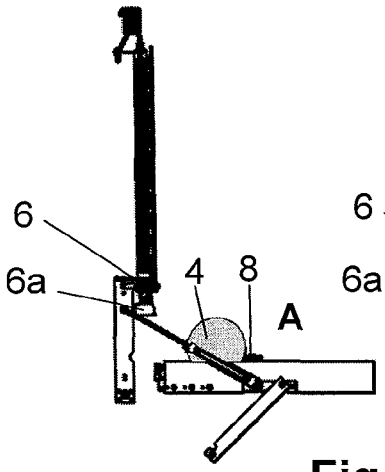
FIGS. 3 to 9 are respective elevational views of the device according to the invention, showing the sequence of movements of a complete work cycle.
Figure 4:
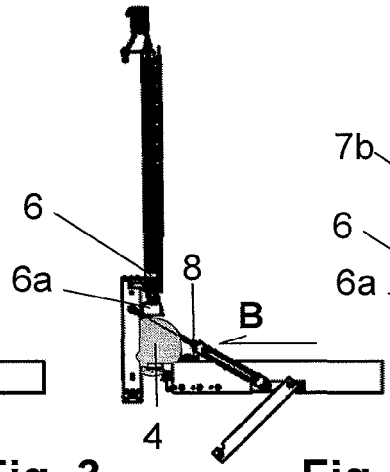
Figure 5:
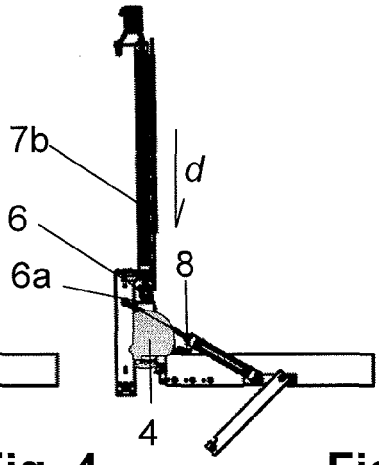
Figure 6:
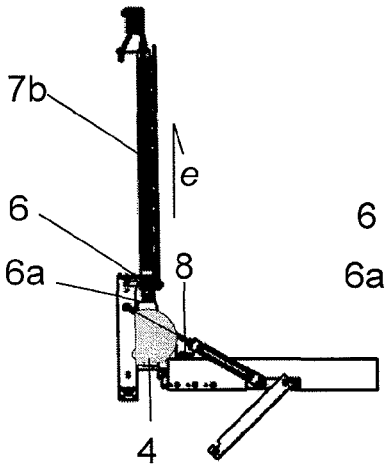
Figure 7:
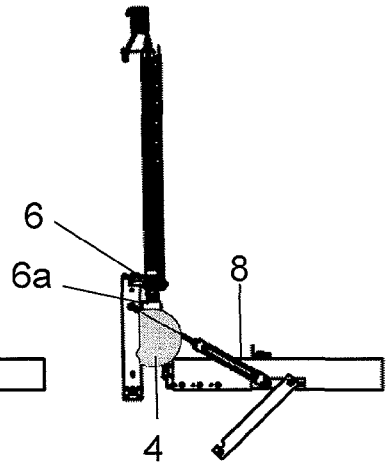
Figure 8:
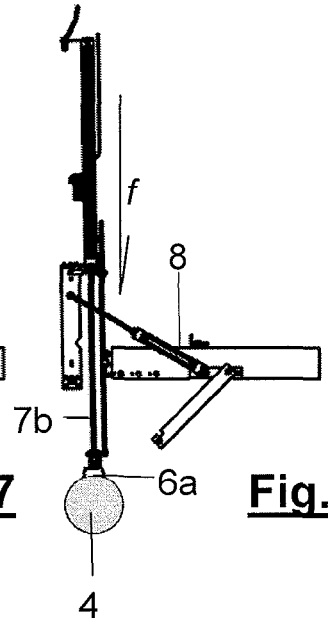
Figure 9:
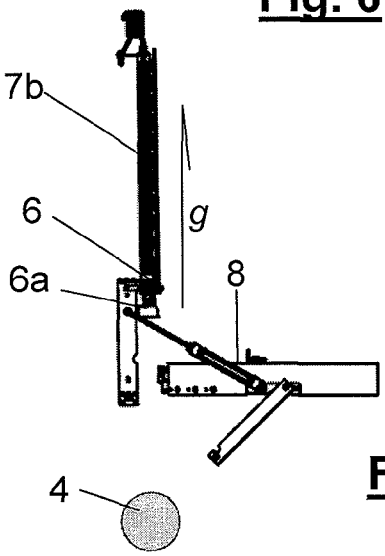

The operation of the device according to the invention is illustrated in FIGS. 3 to 9 and is described below:

With the head 6 in a raised position, a piece 4 is placed in the concavity 8*a* of the carriage 8, when the latter adopts the loading position A (see FIG. 3);

The carriage 8 moves from the initial loading position A to the delivery position B (see FIG. 4);

Then, by mediation of the hydraulic piston 7*a*, the rod 7*b* starts its movement, first moving downwards performing a first vertical downward section d, as indicated by the arrow of FIG. 5, until the suction cup 6*a* of the head 6 is pressed against the piece 4 and grasps it by the effect of the vacuum;

Then, the rod 7*b* moves upwards performing a first short vertical upward section e, as indicated by the arrow of FIG. 6, sufficient to remove the piece 4 from the concavity 8*a* of the carriage 8;

Immediately, the carriage 8 moves away from the delivery position B and moves towards the loading position A, moving outside the path of the head 6 as depicted in FIG. 7;

Immediately afterwards, the rod 7*b* moves downwards performing a second long vertical downward section f, as indicated by the arrow of FIG. 8, keeping the piece 4 grasped until reaching the lower mouth 14 of the tubular body 10, at which time the suction cup 6*a* releases the piece 4;

Then, the rod 7*b* moves upwards performing a second long vertical upward section g, as indicated by the arrow of FIG. 9, until reaching the position depicted in FIG. 3, a new work cycle of the device 1 being started.

Alternatively to the depicted example, the means for the conveyance 3 of the pieces 4 can be formed either by a carriage 8 assembled rotatingly in the fixed structure 9, about a vertical axis, such that it describes an alternating and essentially horizontal circumferential arc movement between the loading A and delivery B positions, and vice versa, or by a support pivotable about a horizontal axis, between the essentially horizontal loading position (A) and the delivery position (B), inclined with respect to the horizontal, in which the support acts as a ramp, the piece 4 moving by gravity from its upper end to its lowest end. This latter variant nevertheless requires the head 6 to describe, in addition to vertical movements, horizontal translational movements so that the ramp does not interfere in its downward path along the tubular body of the machine, or alternatively requires that the ramp can be separated from said path, for example by performing rotating movements about a vertical axis.

The invention claimed is:

1. A device for the filling of bags, applicable to automatic machines for the formation, filling and closing in a continuous process of bags from a tubular mesh, of those comprising a tubular body outside which the storage of tubular mesh is assembled, comprising means for the conveyance of individual pieces of large fruit and vegetable products from a loading position (A) to a delivery position (B), and means for the holding and transfer, one by one, of the individual pieces conveyed to the delivery position, which comprise a head for the holding and subsequent release of the pieces and a mechanism for transmitting to the head a movement the path of which comprises a vertical downward section (f), of a sufficient length to convey each of the held pieces through the inside of the tubular body of the machine towards an upper mouth of a bag open at the upper part, and such that each of the pieces is accompanied in its entire downward path; and wherein the mechanism of the means for the holding and transfer of the pieces imparts to the head a path formed only by vertical upward and downward sections, aligned with the position occupied by the pieces when the means for the conveyance reaches the delivery position.

2. The device according to claim 1, wherein the means for the conveyance of the pieces comprise a carriage assembled movably in a fixed structure and according to an alternating back and forth essentially horizontal linear movement between the end loading (A) and delivery (B) positions, and vice versa.

3. The device according to claim 1, wherein the means for the conveyance of the pieces comprise a carriage assembled rotatingly in a fixed structure about a vertical axis, describing an alternating and essentially horizontal circumferential arc movement between the loading (A) and delivery (B) positions, and vice versa.

4. The device according to claim 1, wherein the means for the conveyance comprises a carriage; and wherein the mechanism of the means for the holding and transfer of the pieces is configured to lead the head while the latter holds a piece until a level below the level of the carriage and in a manner synchronized with the movement thereof, such that at least while the pieces are conveyed along the vertical downward section (f) towards the bag and during the consecutive vertical upward section (g) of the head, the carriage adopts the loading position (A), moved outside the path of the head.

5. The device according to claim 1, wherein the means for the conveyance comprises a carriage; and wherein the carriage comprises a concavity optionally open at its bottom intended to partially house the piece to be conveyed.

6. The device according to claim 5, wherein the carriage comprises stop means to prevent, by the effect of inertia, the piece from coming out of the concavity in which it is housed when the carriage speeds up or slows down in its alternating movement.

7. The device according to claim 1, wherein the mechanism comprises a hydraulic, pneumatic or electric cylinder the plunger of which drives a rod with longitudinal movement, dragging the head in its movement.

8. The device according to claim 1, wherein the head comprises a suction cup suitable for grasping the piece by means of vacuum when it is pressed against the smooth surface of said piece.

9. An automatic machine for the formation, filing and closing in a continuous process of bags, said machine comprising a tubular body and being provided with a device according to claim 1, in which the mechanism for transmitting to the head a vertical movement is adapted to introduce the held piece into the tubular body through the upper open mouth and to convey the held piece through the inside of said tubular body, along the downward section (f), to deliver the held piece though a lower open mouth.

10. A device for the filling of bags, applicable to automatic machines for the formation, filling and closing in a continuous process of bags from a tubular mesh, of those comprising a tubular body outside which the storage of tubular mesh is assembled, comprising means for the conveyance of individual pieces of large fruit and vegetable products from a loading position to a delivery position, and means for the holding and transfer, one by one, of the individual pieces conveyed to the delivery position, which comprise a head for the holding and subsequent release of the pieces and a mechanism for transmitting to the head a movement the path of which comprises a vertical downward section, of a sufficient length to convey the held piece through the inside of the tubular body of the machine towards an upper mouth of a bag open at the upper part, and such that the piece is accompanied in its entire downward path;

wherein the means for the conveyance comprises a carriage; and wherein the carriage comprises a concavity to partially house the piece to be conveyed.

11. The device according to claim 10, wherein the concavity is open at a bottom of the concavity.

12. The device according to claim 10, wherein the carriage comprises stop to prevent, by the effect of inertia, the piece from coming out of the concavity in which the piece is housed when the carriage speeds up or slows down in its alternating movement.

* * * * *